US009041760B2

(12) United States Patent
Tajima et al.

(10) Patent No.: US 9,041,760 B2
(45) Date of Patent: May 26, 2015

(54) OPTICAL PRINT HEAD AND IMAGE FORMING APPARATUS

(71) Applicant: Konica Minolta , Inc., Tokyo (JP)

(72) Inventors: Naoki Tajima, Sagamihara (JP); Yasushi Nagasaka, Okazaki (JP); Takahiro Matsuo, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/100,146

(22) Filed: Dec. 9, 2013

(65) Prior Publication Data

US 2014/0160218 A1 Jun. 12, 2014

(30) Foreign Application Priority Data

Dec. 10, 2012 (JP) ..... 2012-269230

(51) Int. Cl.

| | |
|---|---|
| ***G03G 15/04*** | (2006.01) |
| ***G03G 15/043*** | (2006.01) |
| ***B41J 2/38*** | (2006.01) |
| ***B41J 2/45*** | (2006.01) |

(52) U.S. Cl.

CPC ..... *G03G 15/04054* (2013.01); *G03G 15/0435* (2013.01)

(58) Field of Classification Search

CPC ..... G03G 15/0409; G03G 15/04054; G03G 15/0435; B41J 2/45; B41J 2/385

USPC ..... 347/238, 224

See application file for complete search history.

(56) References Cited

U.S. PATENT DOCUMENTS

| | | | | |
|---|---|---|---|---|
| 4,859,034 | A * | 8/1989 | Shiraishi et al. | 349/3 |
| 7,843,612 | B2 * | 11/2010 | Kimura et al. | 358/474 |
| 2007/0096020 | A1 * | 5/2007 | Mitsugi et al. | 250/239 |
| 2010/0214623 | A1 * | 8/2010 | Shimizu | 358/406 |

FOREIGN PATENT DOCUMENTS

| | | | | |
|---|---|---|---|---|
| JP | H04-180656 | | 6/1992 | |
| JP | 11211957 | A * | 8/1999 | |
| JP | H11-211957 | | 8/1999 | |
| JP | 2000-131998 | | 5/2000 | |
| JP | 2001-026139 | A | 1/2001 | |
| JP | 2001-277586 | | 10/2001 | |
| JP | 2001277586 | A * | 10/2001 | B41J 2/44 |
| JP | 2006-103286 | | 4/2006 | |
| JP | 2008-143025 | | 6/2008 | |
| JP | 2010-089299 | | 4/2010 | |

OTHER PUBLICATIONS

Office Action for corresponding Japanese patent application No. 2012-269230 dated Jan. 6, 2015 and English translation thereof.

* cited by examiner

*Primary Examiner* — Sarah Al Hashimi

(74) *Attorney, Agent, or Firm* — Lucas & Mercanti, LLP

(57) ABSTRACT

An optical print head, including: a light emitting substrate which includes a light emitting element on a base; a rod lens array which focuses light emitted from the light emitting element onto an image carrier, the rod lens array having a larger linear expansion coefficient than the base of the light emitting substrate; and expansion suppressing members which are attached to both lateral surfaces of the rod lens array in a direction that is perpendicular to an optical axis direction and is a shorter direction, each of the expansion suppressing members having a smaller linear expansion coefficient than the rod lens array.

16 Claims, 7 Drawing Sheets

OPTICAL PRINT HEAD AND IMAGE FORMING APPARATUS

BACKGROUND OF THE INVENTION

1. Field of the Invention

The present invention relates to an optical print head and an image forming apparatus including the optical print head.

2. Description of Related Art

Recently, there has been known an exposure device in which an optical print head is configured by using an OLED (Organic Light-Emitting Diode) as a light source of graded index rod lens array (SLA (registered trademark); Selfoc (registered trademark) Lens Array).

In a case of an LED print head (LPH) using an LED (Light Emitting Diode) as a light source, since a plurality of light source blocks are connected to each other to make a light emitting element in a single line, there is a problem of uneven light emission due to variety in luminous point between the light source blocks and placement error between the light source blocks. On the other hand, a light source of OLED can be manufactured as a single light source, and thus can solve the uneven light emission which is the largest problem of LPH.

Furthermore, compared with the element using the LED as the light source, the element using the OLED as the light source has a great advantage in dot position gap and is suitable for high image quality.

Conventionally, in the field of the optical print head which uses the OLED as the light source and the SLA as an imaging optical element, there is disclosed a configuration in which the light emitting substrate of the OLED is directly bonded to the SLA (for example, see Japanese Patent Application Laid Open Publication No. 2001-26139).

Since the light emitting substrate of OLED is exposed to high temperature during the manufacturing process thereof, glass with a particularly small linear expansion coefficient needs to be adopted as glass to be a base substrate. That is, the substrate of the OLED is a material with a very small linear expansion coefficient which is largely different from that of the SLA, and thus a relative position gap due to temperature changes in the surrounding environment has been a large problem.

For example, in a technique described in the above Japanese Patent Application Laid Open Publication No. 2001-26139, there is a risk that the relative position gap occurs due to the temperature changes of surrounding environment since the light emitting substrate of the OLED and the SLA which have very different linear expansion coefficients are bonded to each other.

Specifically, since the SLA is originally for focusing light which is emitted from a single light source through a plurality of rod lenses, the amount of light and light focusing are uneven according to the arrangement pitch of the rod lens array. Accordingly, in conventional SLAs, the whole uneven light emitting is evened mainly by correcting the amount of light for each light emitting dot.

However, the amount of light shifts from the optimum value when the relative position gap occurs between the light emitting substrate of OLED and the rod lens array of SLA since the light amount correction value for each light emitting dot is calculated and stored when the optical print head is manufactured. Accordingly, the amount of light cannot be accurately corrected for each of the light emitting dots, which leads to image deterioration as a result.

SUMMARY OF THE INVENTION

The present invention has been made in consideration of the above problems, and an object of the present invention is to provide an optical print head and an image forming apparatus including the optical print head which can suppress image deterioration caused by a relative position gap between a light emitting substrate and a rod lens array even in a case where the surrounding environment changes.

In order to achieve at least one of the above objects, according to one aspect of the present invention, there is provided an optical print head, including: a light emitting substrate which includes a light emitting element on a base; a rod lens array which focuses light emitted from the light emitting element onto an image carrier, the rod lens array having a larger linear expansion coefficient than the base of the light emitting substrate; and expansion suppressing members which are attached to both lateral surfaces of the rod lens array in a direction that is perpendicular to an optical axis direction and is a shorter direction, each of the expansion suppressing members having a smaller linear expansion coefficient than the rod lens array.

Preferably, in the above optical print head, each of the expansion suppressing members is divided into a plurality of pieces in a longer direction of the rod lens array.

Preferably, in the above optical print head, the expansion suppressing members and the base are formed of glass.

Preferably, in the above optical print head, a surface roughening process is performed on surfaces of the expansion suppressing members contacting the rod lens array and/or surfaces of the rod lens array contacting the expansion suppressing members.

Preferably, in the above optical print head, the surface roughening process is sandblasting.

Preferably, in the above optical print head, the expansion suppressing members are attached to the rod lens array by an ultraviolet curable adhesive.

Preferably, in the above optical print head, the expansion suppressing members are attached to the rod lens array by an adhesive which has a Young's modulus of 150 MPa or more.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, a preferred embodiment of the present invention will be described with reference to the drawings.

Figure 1:
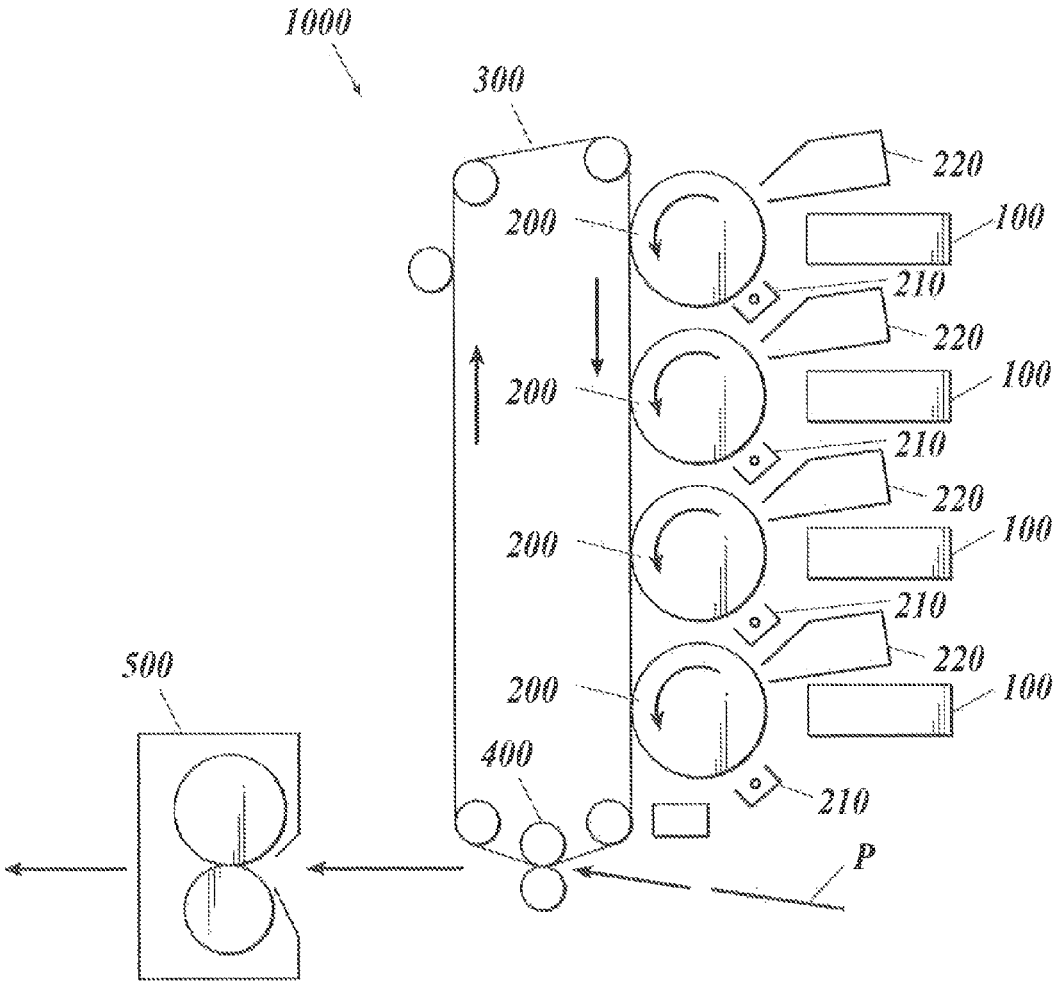
FIG. 1 is a diagram showing a schematic configuration of an image forming apparatus according to the embodiment.

An image forming apparatus 1000 according to the embodiment is used as a printer or a digital copier, for example, and as shown in FIG. 1, configured by including a plurality of optical print heads 100 which are provided by color of cyan, magenta, yellow and black, image carriers 200 such as photosensitive drums which are provided corresponding to the optical print heads 100, charging units 210 which charge the image carriers 200, developing units 220 which make electrostatic latent images appear as images formed with a developing agent by supplying the developing agent to the photo-irradiated image carriers 200, an intermediate transfer belt 300, transfer rollers (transfer unit) 400 which transfer the images formed with the developing agent onto a recording medium, a fixing unit 500 which fixes the image formed with the developing agent that was transferred by the transfer rollers 400 to the recording medium, and others.

The image forming apparatus 1000 forms the electrostatic latent images on the image carriers 200 by the light emitted from the optical print heads 100. Then, the image forming apparatus 1000 makes the electrostatic latent images appear as the images formed with the developing agent by supplying the developing agent to the image carriers 200 on which the electrostatic latent images are formed, and transfers the images formed with the developing agent onto the intermediate transfer belt 300. The image forming apparatus 1000 transfers the images formed with the developing agent which were transferred onto the intermediate transfer belt 300 onto a sheet of paper P as the recording medium by the transfer rollers 400 pressing the images against the sheet P. Then, the image forming apparatus 1000 fixes the image formed with the developing agent onto the sheet P by heating and pressuring the sheet P with the fixing unit 500. The image forming apparatus 1000 conveys the sheet P by paper ejection rollers (not shown in the drawings) or the like to eject the sheet P onto a tray (not shown in the drawings) to perform image forming processing.

Figure 2:
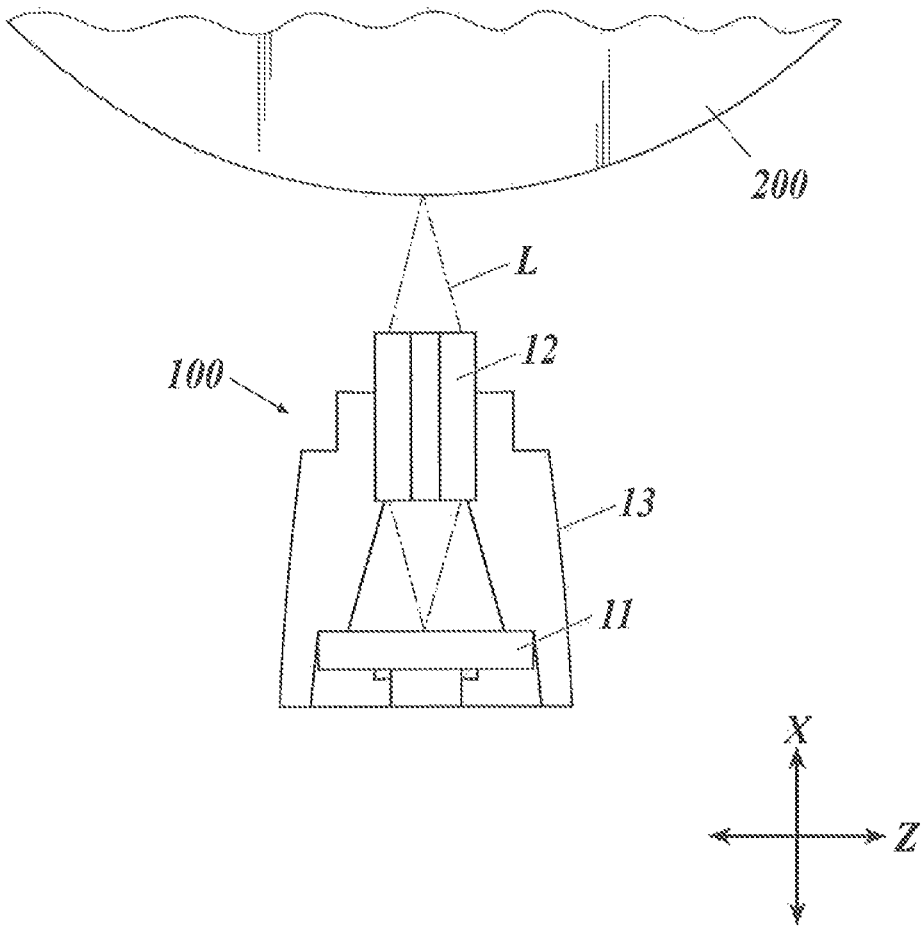
FIG. 2 is a diagram showing a schematic configuration of an optical print head according to the embodiment.

As shown in FIGS. 1 and 2, each of the optical print heads 100 is a device which forms the electrostatic latent image on the image carrier 200 by emitting light L to the image carrier 200 charged by the charging unit 210. Each optical print head 100 includes a light emitting substrate 11 which includes a plurality of light emitting elements emitting the light L and a graded index rod lens array (hereinafter, SLA) 12 which is a rod lens array focusing the light L emitted from the plurality of light emitting elements included in the light emitting substrate 11 onto the image carrier 200. The light emitting substrate 11 and the SLA 12 are held by a holder 13.

In the description below, the longer direction and the shorter direction of the holder 13 shown in FIGS. 2 to 4, for example, are referred to as Y direction and Z direction, respectively, and the direction perpendicular to the Y direction and the Z direction is referred to as X direction. Also, in the optical print head 100 shown in FIGS. 2 to 4, for example, the side to which after-mentioned abutting pins 15 protrude is referred to as upper side and the opposite direction of the upper side is referred to as lower side. In the embodiment, the light L is emitted upward in the X direction from the light emitting substrate 11 located at the lower portion in the X direction of the optical print head 100. That is, the X direction matches the optical axis direction of the light L.

Figure 5:
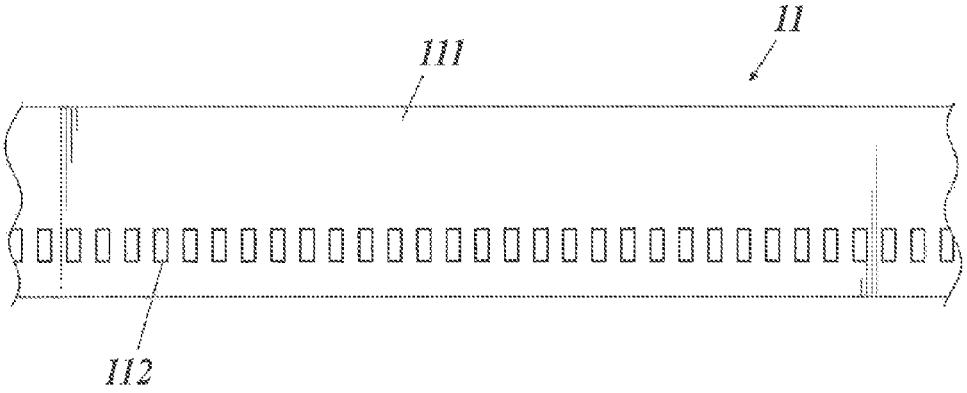
FIG. 5 is a plan view showing a schematic configuration of a light emitting substrate.

The light emitting substrate 11 is configured so that the plurality of light emitting elements 112 are arranged in a nearly straight line on a base 111 which is formed in a nearly rectangle (see FIG. 5). The plurality of light emitting elements 112 may be arranged in a plurality of nearly straight lines. When the plurality of light emitting elements 112 are arranged in the plurality of lines, the light emitting elements 112 are in a staggered arrangement so as to be arranged at slightly different positions in the longer direction so that the light emitting elements 112 do not overlap each other in the shorter direction of the light emitting substrate 11. In the embodiment, OLED is used as the light emitting element 112 and the base 111 of the light emitting substrate 11 is formed of glass which has a small linear expansion coefficient.

The SLA 12 is located between the light emitting substrate 11 and the image carrier 200, and a plurality of rod lenses are arrayed nearly parallel to the line direction of the plurality of the light emitting elements 112 on the light emitting substrate 11. Each of the plurality of rod lenses is formed so that the refractive index is low at the central axis, that is, the optical axis, and becomes higher with distance from the central axis increasing. The beams emitted from the plurality of light emitting elements 112 in the light emitting substrate 11 are transmitted through the plurality of rod lenses of the SLA 12 to form an image as a minute spot on the surface of the image carrier 200. Also, the SLA 12 has a larger linear expansion coefficient than that of the base 111 of the light emitting substrate 11.

The holder 13 is formed of liquid crystal polymers and configured so as to hold the light emitting substrate 11 and the SLA 12. The liquid crystal polymer has a smaller linear expansion coefficient than that of the SLA 12 and can have a nearly same linear expansion coefficient as the base 111 of the light emitting substrate 11 by adjusting the materials to be blended. The material of the holder 13 is not limited to the liquid crystal polymer, and other resin or metal may be used as long as the linear expansion coefficient thereof is nearly the same as that of the base 111 of the light emitting substrate 11.

Figure 3:
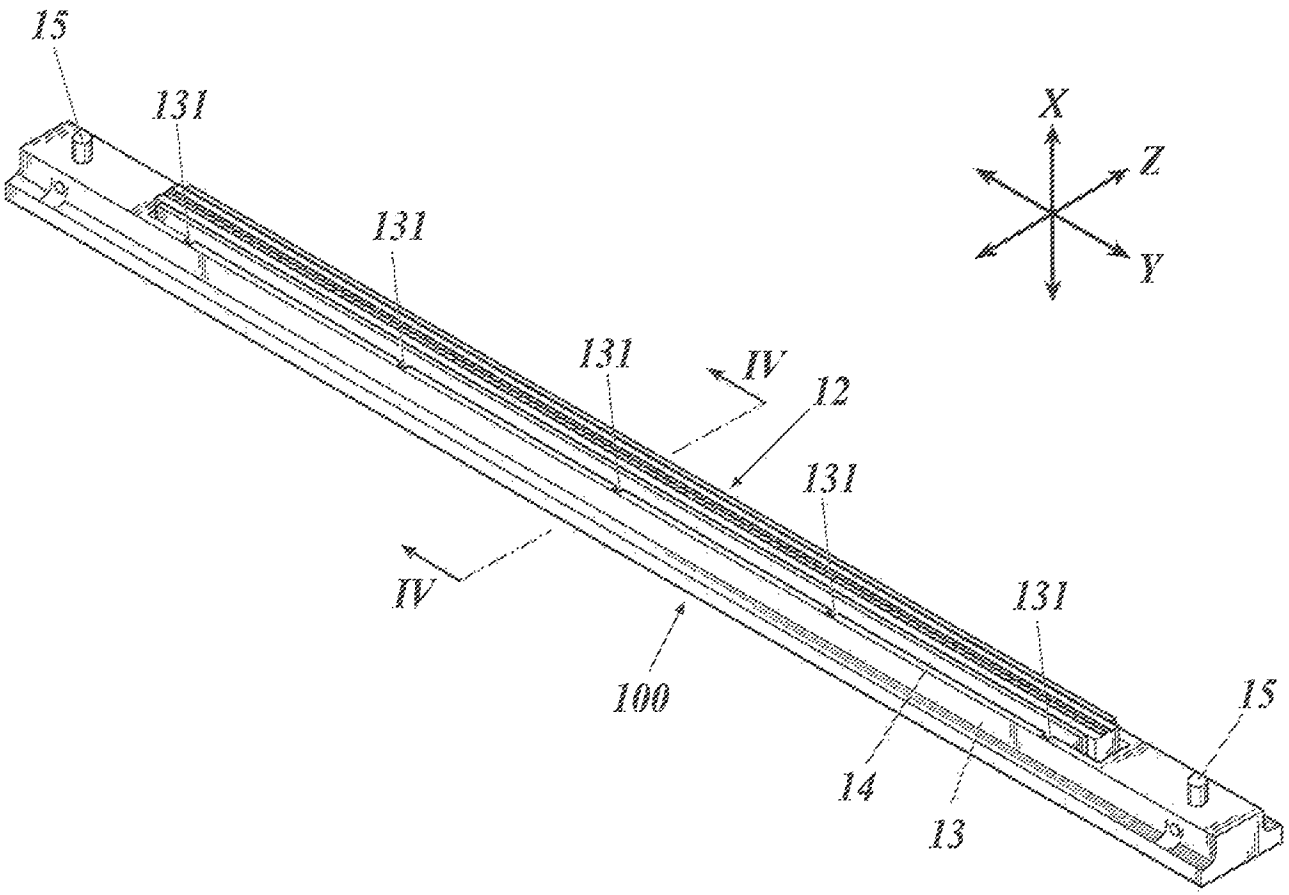
FIG. 3 is a schematic view showing an entire configuration of the optical print head according to the embodiment.
Figure 4:
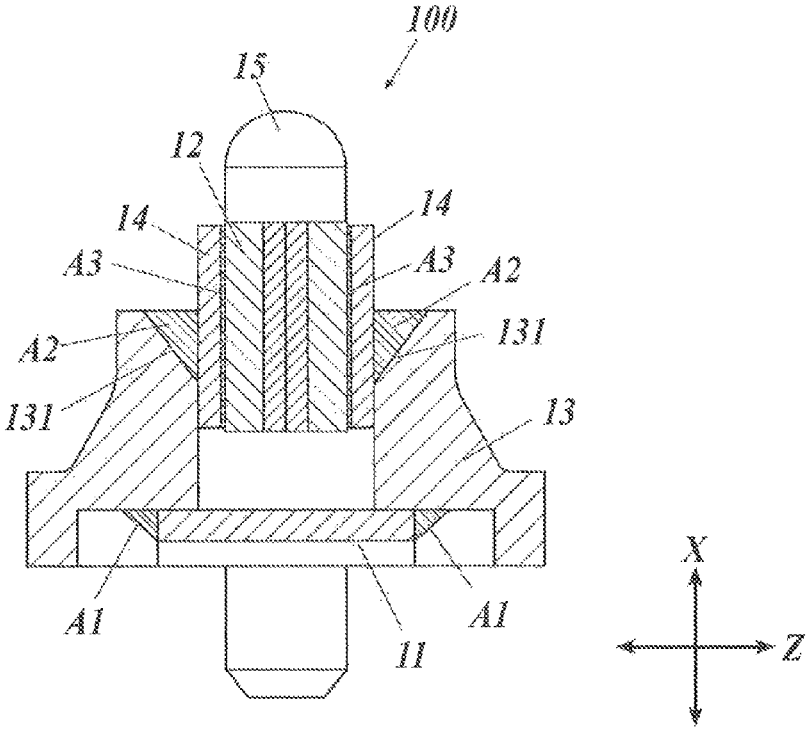
FIG. 4 is a sectional view showing an example of a portion along the line IV-IV in FIG. 3.

As shown in FIGS. 3 and 4, the light emitting substrate 11 is bonded to be fixed to the lower portion in the X direction of the holder 13 by an ultraviolet curable adhesive A1. In the embodiment, the light emitting substrate 11 is fixed at five positions per side, that is, a total of ten positions.

The SLA 12 is adjusted to be fixed to the upper portion in the X direction of the holder 13. In the embodiment, the SLA 12 is fixed at five positions per side of the lateral surfaces in the shorter direction (Z direction), that is, a total of ten positions. Specifically, on each of the surfaces of the holder 13 which are contacting the SLA 12 (exactly, contacting after-mentioned expansion suppressing members 14), five hole units 131 are provided with predetermined intervals along the longer direction, and an ultraviolet curable adhesive A2 is injected into the hole units 131 to bond and fix the holder 13 to the SLA 12.

Expansion suppressing members 14 are attached to the SLA 12 by an ultraviolet curable adhesive A3. The ultraviolet curable adhesive A3 is approximately 5 to 20 μm in thickness and applied nearly throughout the expansion suppressing members 14.

Each of the expansion suppressing members 14 is formed of a material such as glass as in the base 111 of the light emitting substrate 11 which has a smaller liner expansion coefficient than that of the SLA 12, and a total of two expansion suppressing members 14 are attached to the lateral surfaces in the Z direction of the SLA 12 with one expansion suppressing member 14 per surface. The lateral surfaces in the Z direction of each of the expansion suppressing members 14 are mirror surfaces. In the embodiment, as the expansion suppressing member 14, EAGLE XG manufactured by Corning Inc. is used. As for thickness, 0.7 mm which is most distributed is adopted. If the expansion suppressing member 14 is thicker, the effect of suppressing the expansion of the SLA 12 is further improved. This is because the EAGLE XG has Young's modulus approximately ten times as high as that of the SLA 12, and the suppressing effect is improved as the material with a high Young's modulus is thicker.

In the embodiment, each of the expansion suppressing members 14 is attached to the SLA 12 by the ultraviolet curable adhesive A3. When the ultraviolet curable adhesive A3 with Young's modulus of 150 MPa or more is used, a better expansion suppressing effect can be expected. Accordingly, in the embodiment, the ultraviolet curable adhesive A3 with Young's modulus of 150 MPa or more is used.

The abutting pins 15 are provided at both ends in the longer direction (Y direction) of the holder 13.

The abutting pins 15 are members to decide the distance between the optical print head 100 and the image carrier 200, and configured to abut at a housing (not shown in the drawings) which holds the image carrier 200. The abutting portions of the housing ensure a precise positional relationship with the image carrier 200. The height of protruding portions of the abutting pins 15 is adjusted to be fixed so that the light emitting substrate 11 and the image carrier 200 have the optimum positional relationship therebetween.

Next, a method of attaching the expansion suppressing members 14 to the SLA 12 will be described.

Figure 6A:
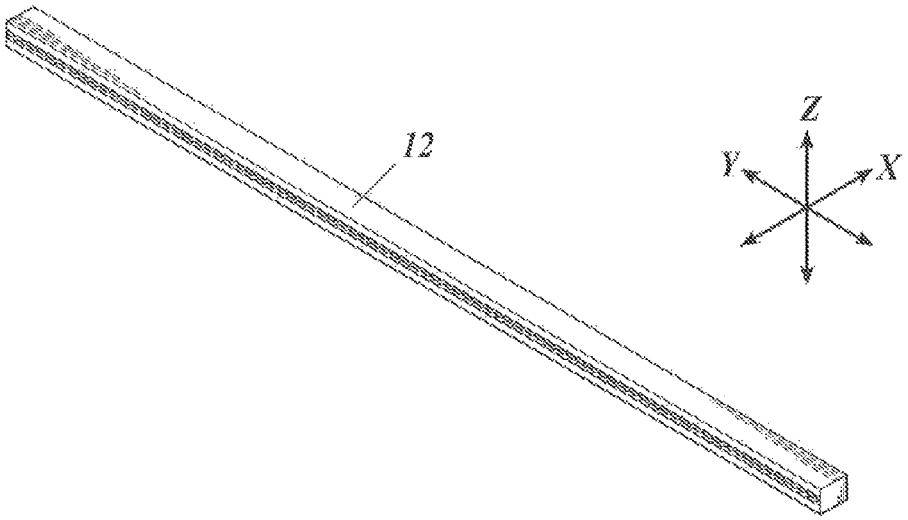
FIG. 6A is a diagram showing warps in a graded index rod lens array.
Figure 6B:
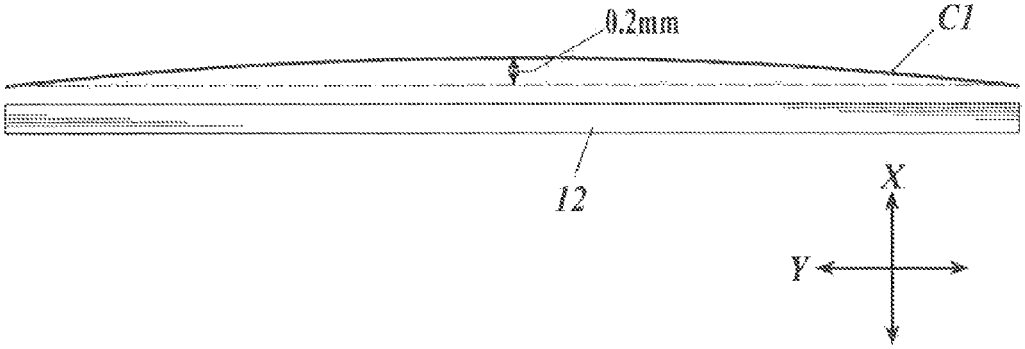
FIG. 6B is a diagram showing a warp in a graded index rod lens array.
Figure 6C:
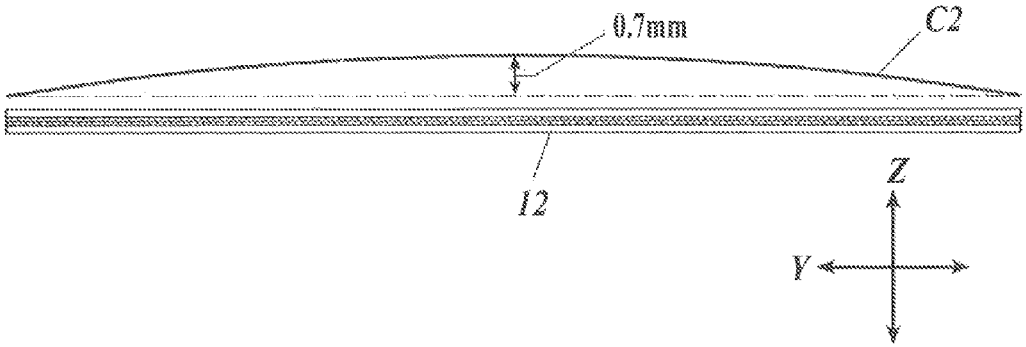
FIG. 6C is a diagram showing a warp in a graded index rod lens array.

The SLA 12 normally has warps as shown in FIG. 6. Specifically, for example, the SLA 12 has a warp up to 0.2 mm in the optical axis direction (X direction) and a warp up to 0.7 mm in the direction (Z direction) perpendicular to the optical axis direction (see FIGS. 6B and 6C). C1 shown in FIG. 6B and C2 shown in FIG. 6C schematically illustrate the warp in the optical axis direction and the warp in the direction perpendicular to the optical axis direction, respectively. If the SLA 12 is used in a warped state, the warp in the optical direction possibly leads to a field curvature. On the other hand, if the SLA 12 is warped in the direction perpendicular to the optical axis direction, the amount of light is possibly uneven since the straightness cannot be held with respect to the nearly straight array in the longer direction of the plurality of light emitting elements 112 on the light emitting substrate 11. Accordingly, the SLA 12 having the above warps can lead to a large loss of quality of the exposure beam to the image carrier 200.

Thus, in the embodiment, when the expansion suppressing members 14 are attached to the SLA 12, the assembly work is performed while correcting the warps of the SLA 12 by using an attachment jig 20.

In the embodiment, correction is easy to perform since the SLA 12 is slender and the material of the member holding the rod lenses is made of resin. For example, correction can be performed to the warp of 0.2 mm in the optical axis direction by a force of approximately 20 g and to the warp of 0.7 mm in the direction perpendicular to the optical axis direction by a force of approximately 20 g.

Figure 7:
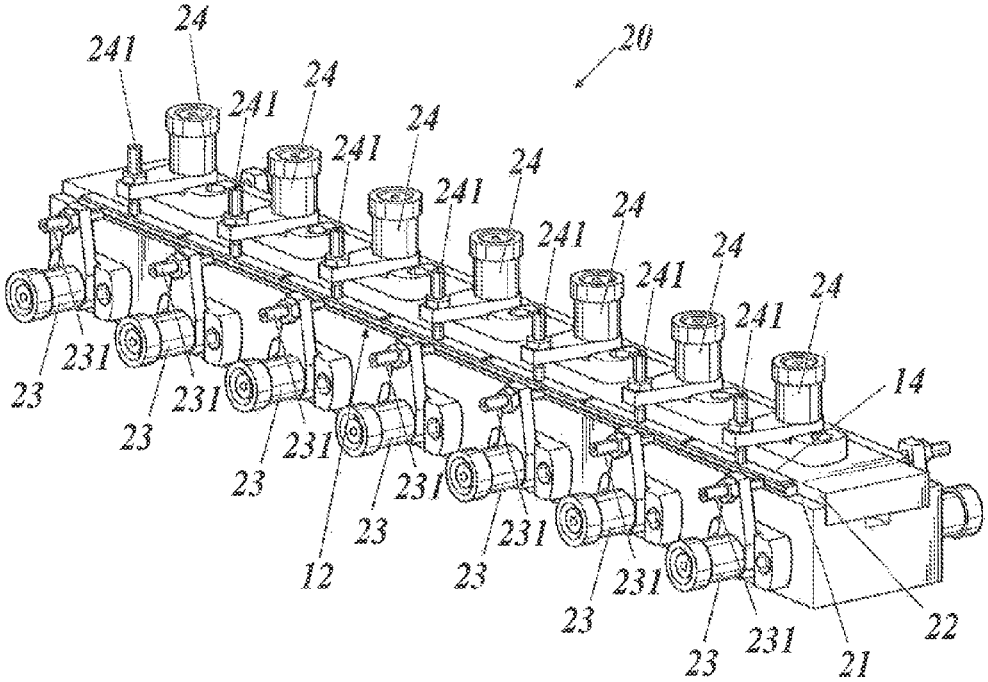
FIG. 7 is a schematic view showing an entire configuration of an attachment jig.

As shown in FIG. 7, the attachment jig 20 is a device for attaching the expansion suppressing member 14 in a state of correcting the warps of the SLA 12. The attachment jig 20 is formed in a nearly prismatic shape. A first attachment reference plane 21 which is nearly parallel to the upper surface portion of the attachment jig 20 and a second attachment reference plane 22 which is nearly parallel to the lateral surface portion are formed along the longer direction at an end of the shorter direction of the upper end. The first attachment reference plane 21 and the second attachment reference plane 22 have a highly enhanced flatness which is precisely polished since they are provided for correcting the warps of the SLA 12.

In addition, a plurality of (seven in the embodiment) first fixing members 23 for pressing the SLA 12 from a lateral side are provided along the longer direction on the lateral surface portion on which the first attachment reference plane 21 and the second attachment reference plane 22 of the attachment jig 20 are formed. At the upper end of each of the first fixing members 23, a pressing unit 231 movable in the shorter direction of the attachment jig 20 is provided. The pressing unit 231 is provided so as to be nearly as high as the second attachment reference plane 22. Accordingly, by moving the pressing unit 231 toward the second attachment reference plane 22, the SLA 12 placed on the first attachment reference plane 21 can be pressed against the second attachment reference plane 22.

Also, a plurality of (seven in the embodiment) second fixing members 24 pressing the SLA 12 from above are provided along the longer direction on the upper surface portion of the attachment jig 20. A pressing unit 241 which is movable upward and downward is provided at an end in the shorter direction of each of the second fixing members 24. The pressing unit 241 is provided at the upper position of the first attachment reference plane 21. Accordingly, by lowering the pressing unit 241 toward the first attachment reference plane 21, the SLA 12 placed on the first attachment reference plane 21 can be pressed against the first attachment reference plane 21.

The number of the first fixing members 23 and the second fixing members 24 is not limited to seven, and any number of the first fixing members 23 and the second fixing members 24 can be provided.

When attaching the expansion suppressing members 14 to the SLA 12, first, the SLA 12 is placed on the first attachment reference plane 21 with one lateral surface up.

Next, the SLA 12 is pressed from a lateral side against the second attachment reference plane 22 by the first fixing members 23. Thus, the warp in the optical axis direction of the SLA 12 is corrected.

Then, the ultraviolet curable adhesive A3 is applied to the upper side, that is, the one lateral surface of the SLA 12, and the expansion suppressing member 14 is attached to the adhesive-applied surface.

The expansion suppressing member 14 and the SLA 12 are Dressed against the first attachment reference plane 21 from above by the second fixing members 24. Thus, the warp in the direction perpendicular to the optical axis direction of the SLA 12 is corrected.

Then, light (ultraviolet light) is emitted to the SLA 12 to which the expansion suppressing member 14 is attached. Thus, since the ultraviolet curable adhesive A3 is cured, the SLA 12 is bonded to the expansion suppressing member 14.

The SLA 12 to which the expansion suppressing member 14 is attached is turned over, and the SLA 12 is placed on the first attachment reference plane 21 with the other lateral surface up.

Thereafter, the same processing as the processing of attaching the expansion suppressing member 14 to the one lateral surface is performed to attach the expansion suppressing member 14 to the other lateral surface.

As described above, in the embodiment, the expansion suppressing members 14 are attached by pressing the SLA 12 against the two reference planes (first attachment reference plane 21 and second attachment reference plane 22). Thus, the expansion suppressing members 14 can be attached while correcting the warps of the SLA 12. Accordingly, after attaching the expansion suppressing members 14, the warps of the SLA 12 are corrected and optical performance of the optical print head 100 can be improved.

Here, in a case of fixing the SLA 12 in the holder 13, since the inserting portion is a clearance fit to some extent, the SLA 12 is warped by the clearance when the expansion suppressing member 14 is not attached thereto. Since the holder 13 itself is normally made of resin, the Young's modulus thereof is smaller than that of glass and the effect of suppressing the warps is also limited. Accordingly, by attaching a member such as glass having a high Young's modulus as the expansion suppressing member 14, the effect of suppressing the warp can be enhanced and the quality of the beam can be improved.

Next, a method of positioning the optical print head 100 will be described.

First, the positioning in the X direction (optical axis direction) is performed for the holder 13 to which the light emitting substrate 11 is previously bonded and the SLA 12 to which the expansion suppressing member 14 is previously attached. Specifically, the positions in the X direction of the light emitting substrate 11 and the SLA 12 are adjusted so that the image to be formed on the surface of the image carrier 200, that is, at the image plane position has a nearly smallest diameter.

Then, the SLA 12 is bonded to the holder 13 by the ultraviolet curable adhesive A2. Thus, the positioning in the X direction of the light emitting substrate 11 and the SLA 12 is completed.

Thereafter, a light adjustment value is set to be stored for each of the light emitting elements 112 so that the light quantity at the image plane position of each of the light emitting elements 112 on the light emitting substrate 11 stays constant. The light quantity may be measured to maintain the exposure uniformity at the image plane position. Measurement of the beam shape and MTF (Modulation Transfer Function) can also be used as a known means for the measuring evaluation of the exposure uniformity.

Finally, positioning is performed on the abutting pins 15. In a case where abutting portions of the housing which holds the image carrier 200 are located at a position equivalent to the surface of the image carrier 200, for example, the ends of the abutting pins 15 are located at a design image plane position. Also, in a case where the abutting portions are located at a position of being offset from the surface position of the image carrier 200, for example, the ends of the abutting pins 15 are located at positions shifted from the design image plane position by the amount of offset.

As described above, according to the embodiment, the optical print head 100 includes the light emitting substrate 11 which includes the light emitting elements 112 on the base 111, the SLA 12 which focuses the light L emitted from the light emitting element 112 onto the image carrier 200 and has a larger linear expansion coefficient than that of the base 111 of the light emitting substrate 11, and the expansion suppressing members 14 which are attached to the lateral surfaces in the shorter direction (Z direction) perpendicular to the optical axis direction of the SLA 12 and have a smaller linear expansion coefficient than that of the SLA 12. Thus, the expansion of the SLA 12 according to the change in temperature and humidity can be suppressed even when there is a difference in linear expansion coefficient between the base 111 of the light emitting substrate 11 and the SLA 12. Accordingly, the relative position gap between the light emitting substrate 11 and the SLA 12 can be suppressed and the deterioration of the beam quality caused by the relative position gap can be suppressed. As a result, the image deterioration can be suppressed.

Furthermore, according to the optical print head 100 of the embodiment, since the expansion suppressing members 14 and the base 111 of the light emitting substrate 11 are formed of glass, both of them are formed of the same material, which can improve the effect of suppressing the expansion of the SLA 12. Thus, the relative position gap between the light emitting substrate 11 and the SLA 12 can be suppressed.

Also, according to the optical print head 100 of the embodiment, since the expansion suppressing members 14 are attached to the SLA 12 by the ultraviolet curable adhesive A3, the warps which the SLA 12 originally has can be effectively corrected by utilizing the difference in Young's modulus.

Especially, according to the optical print head 100 of the embodiment, since the ultraviolet curable adhesive A3 has a Young's modulus which is 150 MPa or more, a better expansion suppressing effect can be expected. Thus, the relative position gap can be suppressed between the light emitting substrate 11 and the SLA 12.

Though the embodiment according to the present invention has been specifically described above, the present invention is not limited to the above embodiment and changes can be made within the scope of the invention,

Modification Example 1

Figure 8:
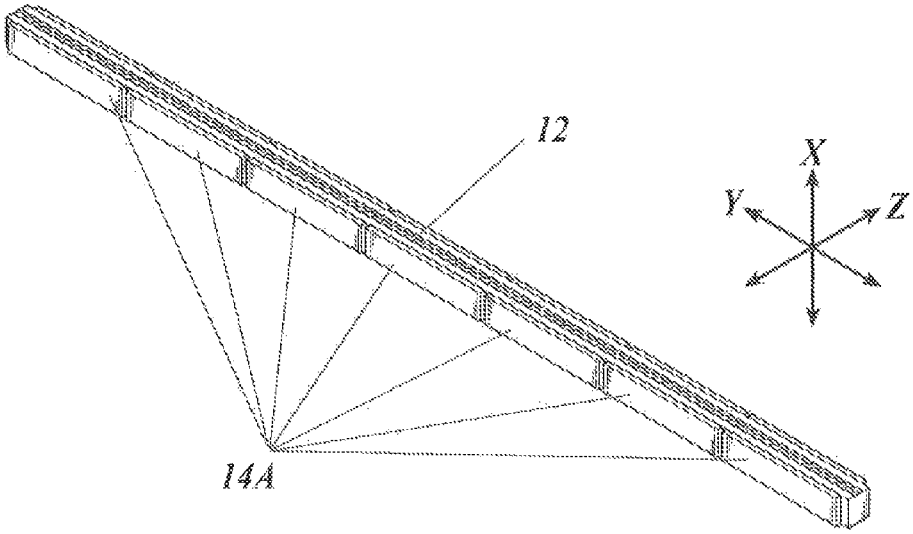
FIG. 8 is a schematic view showing a modification example of an expansion suppressing member.

For example, in an example shown in FIG. 8, the configuration of the expansion suppressing member 14 is different from that of the embodiment. To simplify the description, the detailed explanation is omitted by providing same reference numerals to the same configuration as the embodiment.

The expansion suppressing member 14A according to the modification example 1 is divided into a plurality of sheets to be attached to the SLA 12. Specifically, as shown in FIG. 8, the expansion suppressing member 14A is divided into seven sheets in the longer direction (Y direction) of the SLA 12 and the sheets are attached to the SLA 12 by the ultraviolet curable adhesive A3 in a state of being slightly separated from each other. The expansion suppressing member 14A is attached to each of the lateral surfaces in the Z direction of the SLA 12 as in the embodiment.

When a single long sheet of the expansion suppressing member 14 is attached as in the embodiment, there is a risk that peeling occurs at the interface of the ultraviolet curable adhesive A3 at the maximum change of the temperature and humidity, leading to a loss of function of suppressing the expansion. This is because the expansion difference due to the difference in linear expansion coefficient between the SLA 12 and the expansion suppressing member 14 becomes largest and thus cannot be held by the adhesive strength of the ultraviolet curable adhesive A3.

In the modification example 1, by dividing a sheet of expansion suppressing member 14A into a plurality of sheets in the longer direction, the expansion difference per a sheet can be reduced. Thus, the interfacial peeling of the ultraviolet curable adhesive A3 can be prevented.

The division number of the expansion suppressing member 14A is not limited to seven, and the expansion suppressing member 14A can be divided into an arbitrary number of sheets. When the division number is larger, the expansion difference per a sheet can be smaller, and thus the interfacial peeling of the ultraviolet curable adhesive A3 can be prevented more surely. On the other hand, when the division number is smaller, the attachment process can be reduced, which reduces the operation time. That is, the division number is appropriately set according to the environmental fluctuation range so as not to cause the interfacial peeling of the ultraviolet curable adhesive A3.

As described above, according to the optical print head 100 of the modification example 1, the expansion suppressing member 14A is divided into a plurality of sheets in the longer direction of the SLA 12, and thus the expansion difference per a sheet can be reduced. Thus, the interfacial peeling of the ultraviolet curable adhesive A3 can be prevented and the reliability of the adhesion can be improved.

Modification Example 2

Figure 9:
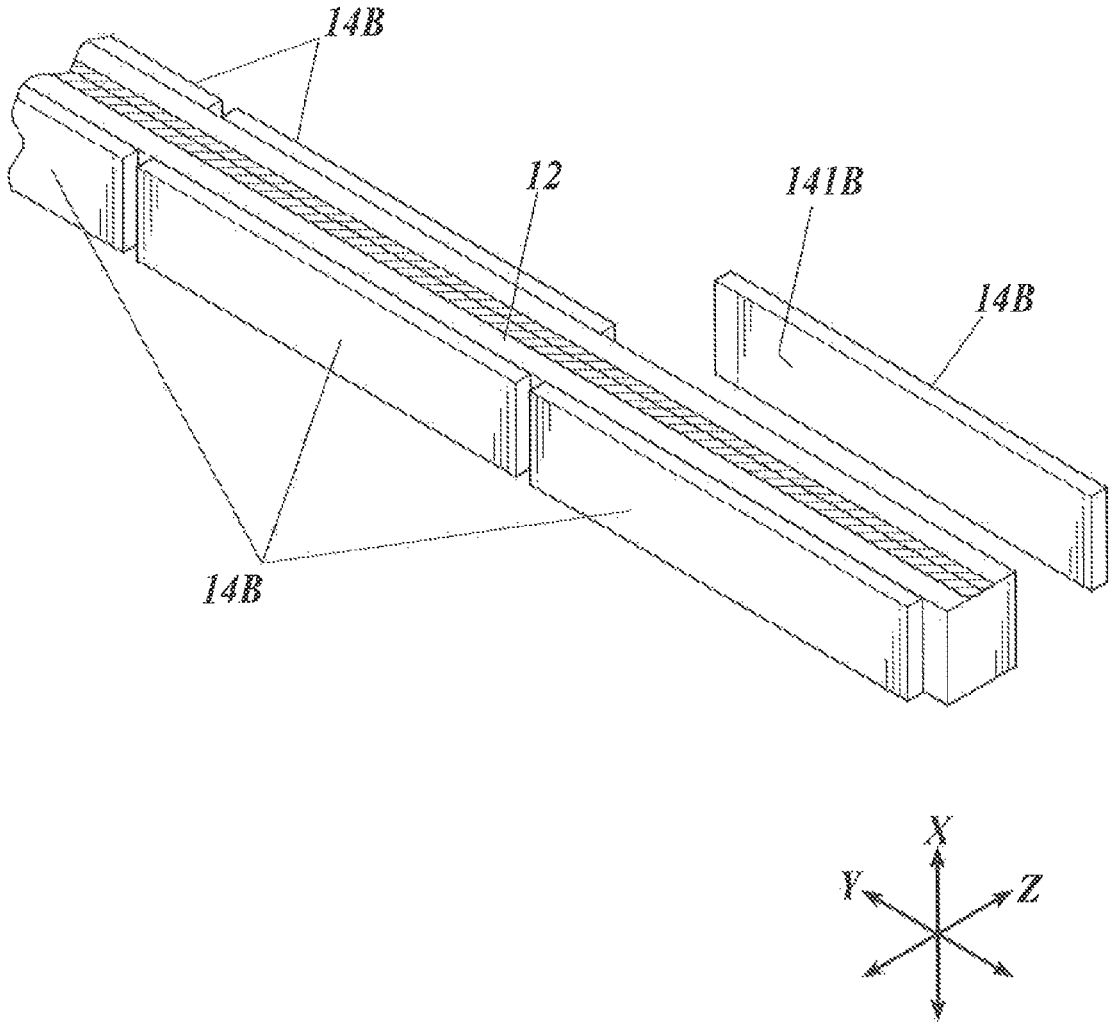
FIG. 9 is a schematic view showing a modification example of the expansion suppressing member.

In addition, in an example shown in FIG. 9, the configuration of the expansion suppressing member 14 is different from those of the embodiment and the modification example 1. To simplify the description, the detailed explanation thereof is omitted by providing same reference numerals to the same configuration as the embodiment and the modification example 1.

As for each of the expansion suppressing members 14B according to the modification example 2, sandblasting is performed on the surface contacting the SLA 12, that is, the lateral surface (adhesive application surface) 141B to be bonded to the SLA 12. In the modification example 2, No. 180 is selected as a count of sandblasting. By performing the sandblasting on the adhesive application surface 141B of the expansion suppressing member 14B, the adhesive application surface can be roughed, which can enhance the adhesive strength and prevent the interfacial peeling of the ultraviolet curable adhesive A3. The lateral surface which is the opposite side of the adhesive application surface 141B of the expansion suppressing member 14B is a mirror surface as in the embodiment and the modification example 1.

By applying the ultraviolet curable adhesive A3 to the adhesive application surface 141B to which the sandblasting is performed, the cloudy surface is solved to be transparent. Accordingly, the ultraviolet can be effectively transmitted through the expansion suppressing member 14B toward the ultraviolet curable adhesive A3.

Though the sandblasting is performed on the adhesive application surfaces 141B of the expansion suppressing members 14B in the modification example 2, the present invention is not limited to this and any processing may be performed as long as the surfaces of the adhesive application surfaces 141B of the expansion suppressing members 14B can be roughed. For example, chemical cleaning, UV cleaning, plasma cleaning, application of primer, and such like may be performed.

Here, the feature of sandblasting is that the surface can be roughed at a low cost. Accordingly, in the modification example 2, more favorable effect can be obtained by performing the sandblasting on the adhesive application surfaces 141B of the expansion suppressing members 14B than the effect by the other processing.

Though the sandblasting is performed on the adhesive application surfaces 141B of the expansion suppressing members 14B in the modification example 2, the present invention is not limited to this. For example, instead of the adhesive application surfaces 141B of the expansion suppressing members 14B, the same sandblasting may be performed on the surfaces of the SLA 12 contacting the expansion suppressing members 14B, that is, the adhesive application surfaces, or the sandblasting may be performed on both of the adhesive application surfaces 141B of the expansion suppressing members 14B and the adhesive application surfaces of the SLA 12.

As described above, according to the optical print head 100 of the modification example 2, since the surface roughening process is performed on the surfaces (adhesive application surfaces 141B) of the expansion suppressing members 14B contacting the SLA 12 and/or the surfaces of the SLA 12 contacting the expansion suppressing members 14B, the surfaces to which the ultraviolet curable adhesive A3 is to be applied are roughed. Accordingly, the adhesive strength is enhanced and the interfacial peeling of the ultraviolet curable adhesive A3 can be prevented, which improves reliability of the adhesion.

Furthermore, according to the optical print head 100 of the modification example 2, since the sandblasting is selected as the surface roughening process, the surfaces can be roughed at a low cost.

Other Modification Examples

Though glass is used as the expansion suppressing members 14 in the embodiment, the present invention is not limited to this. For example, a thin ceramic plate material may be used and a steel or tungsten plate material which has a relatively large Young's modulus and a relatively small linear expansion coefficient may be used.

Though the ultraviolet curable adhesive A3 is used as an adhesive when attaching the SLA 12 to the expansion suppressing members 14 in the embodiment, the present invention is not limited to this. An appropriate adhesive may be selected according to the quality of material of the expansion suppressing members 14. For example, a heat curable adhesive may be used. Even in a case of using the adhesive other than the ultraviolet curable adhesive A3, a better expansion suppressing effect can be expected as long as the adhesive has a Young's modulus of 150 MPa or more.

Also, as for the other detailed configuration of each of the devices forming the optical print head and the image forming apparatus and the detailed operation thereof, changes can be made appropriately within the scope of the present invention.

According to one aspect of the preferred embodiment of the present invention, there is provided an optical print head, including: a light emitting substrate which includes a light emitting element on a base; a rod lens array which focuses light emitted from the light emitting element onto an image carrier, the rod lens array having a larger linear expansion coefficient than the base of the light emitting substrate; and expansion suppressing members which are attached to both lateral surfaces of the rod lens array in a direction that is perpendicular to an optical axis direction and is a shorter direction, each of the expansion suppressing members having a smaller linear expansion coefficient than the rod lens array.

Such optical print head can suppress the expansion of rod lens array due to the temperature and humidity change even when there is a difference in linear expansion coefficient between the base of the light emitting substrate and the rod lens array. Accordingly, the relative position gap between the light emitting substrate and the rod lens array can be suppressed and the deterioration of the beam quality caused by the relative position gap can be suppressed. As a result, the image deterioration can be suppressed.

The entire disclosure of Japanese Patent Application No. 2012-269230 filed on Dec. 10, 2012 including description, claims, drawings, and abstract are incorporated herein by reference in its entirety.

What is claimed is:

1. An optical print head, comprising:

a light emitting substrate which includes a light emitting element on a base;

a rod lens array which focuses light emitted from the light emitting element onto an image carrier, the rod lens array having a larger linear expansion coefficient than the base of the light emitting substrate;

a holder which holds the light emitting substrate and the rod lens assembly; and expansion suppressing members which are attached to both lateral surfaces of the rod lens array in a direction that is perpendicular to an optical axis direction and is a shorter direction and attached to the holder, each of the expansion suppressing members being disposed between the rod lens array and the holder, each of the expansion suppressing members being an element that is separate from the holder and the rod lens assembly, and each of the expansion suppressing members having a smaller linear expansion coefficient than the rod lens array.

2. The optical print head of claim 1, wherein each of the expansion suppressing members is divided into a plurality of pieces in a longer direction of the rod lens array.

3. The optical print head of claim 1, wherein the expansion suppressing members and the base are formed of glass.

4. The optical print head of claim 1, wherein surfaces of the expansion suppressing members contacting the rod lens array and/or surfaces of the rod lens array contacting the expansion suppressing members are roughened surfaces.

5. The optical print head of claim 4, wherein the roughened surfaces are sandblasted surfaces.

6. The optical print head of claim 1, wherein the expansion suppressing members are attached to the rod lens array by an ultraviolet curable adhesive.

7. The optical print head of claim 1, wherein the expansion suppressing members are attached to the rod lens array by an adhesive which has a Young's modulus of 150 MPa or more.

8. An image forming apparatus, comprising:

an image carrier;

a charging unit which charges the image carrier;

the optical print head of claim 1 which forms an electrostatic latent image on the image carrier by emitting light to the image carrier charged by the charging unit;

a developing unit which makes the electrostatic latent image appear as an image formed with a developing agent by supplying the developing agent to the image carrier to which the light is emitted;

a transfer unit which transfers the image formed with the developing agent to a recording medium; and a fixing unit which fixes the image that is formed with the developing agent and transferred by the transfer unit to the recording medium.

9. The optical print head of claim 1, wherein the rod lens array has a rod lens and a member sandwiching the rod lens between both lateral surfaces thereof in the direction that is perpendicular to the optical axis direction and is the shorter direction.

10. The optical print head of claim 1, wherein the expansion suppressing members are attached to both lateral surfaces of the rod lens array in the direction that is perpendicular to the optical axis direction and is the shorter direction and attached to the holder by a second attachment which is different from a first attachment for forming the rod lens array.

11. The optical print head of claim 10, wherein the surface of each of the expansion suppressing members which is opposite to the surface thereof attached to the rod lens array in the shorter direction is attached to the holder by the second attachment.

12. The optical print head of claim 1, wherein at least a portion of the expansion suppressing members and a rod lens array are below an upper surface of the holder.

13. The optical print head of claim 1, wherein the holder and the expansion suppressing members are made from different materials.

14. The optical print head of claim 1, wherein the holder holds the light emitting substrate and the rod lens array so that there is a space between the light emitting substrate and the rod lens array, and the expansion suppressing members are attached to the rod lens array along a length in the optical axis direction.

15. The optical print head of claim 1, wherein the holder and the rod lens array are attached to each of the expansion suppression members on opposing sides of the each of the expansion suppressing members.

16. The optical print head of claim 1, wherein the holder contacts the expansion suppression members with two opposing surfaces of the holder, the two opposing surfaces each form a plurality of hole units with the expansion suppression members at predetermined intervals along the longitudinal direction, and an adhesive is injected into the hole units to fix the holder to the rod lens array.

* * * * *